US009733023B2

(12) United States Patent
Sullivan

(10) Patent No.: US 9,733,023 B2
(45) Date of Patent: Aug. 15, 2017

(54) RETURN WATERBOX FOR HEAT EXCHANGER

(71) Applicant: TRANE INTERNATIONAL INC., Piscataway, NJ (US)

(72) Inventor: Brian Thomas Sullivan, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 282 days.

(21) Appl. No.: 14/445,905

(22) Filed: Jul. 29, 2014

(65) Prior Publication Data

US 2015/0034284 A1 Feb. 5, 2015

Related U.S. Application Data

(60) Provisional application No. 61/860,480, filed on Jul. 31, 2013.

(51) Int. Cl.
*F28F 9/02* (2006.01)
*F28D 7/16* (2006.01)

(52) U.S. Cl.
CPC ..... *F28D 7/1607* (2013.01); *F28F 9/0229* (2013.01); *F28F 9/0265* (2013.01)

(58) Field of Classification Search
CPC ..... F28D 7/1607; F28F 9/0229; F28F 9/0265
USPC ..... 239/158; 165/158
See application file for complete search history.

(56) References Cited

U.S. PATENT DOCUMENTS 267,797 A 11/1882 Miles
1,725,322 A 8/1929 Melbourne
1,989,430 A 1/1935 Simmen
3,802,498 A 4/1974 Romanos
4,089,368 A 5/1978 Bell et al.
4,474,011 A 10/1984 Nelson et al.
4,502,530 A * 3/1985 Huenniger ..... F28F 9/0219 165/158
4,520,867 A 6/1985 Sacca et al.
4,660,632 A 4/1987 Yampolsky et al.
4,972,903 A 11/1990 Kwok
5,558,157 A * 9/1996 Makowski ..... F28G 13/00 122/379
6,161,613 A 12/2000 Huenniger
6,640,579 B2 11/2003 Matsushima et al.
6,883,347 B2 4/2005 Ayub
(Continued)

FOREIGN PATENT DOCUMENTS

CN 201811609 U 4/2011

OTHER PUBLICATIONS

Chinese Office Action; Chinese Patent Application No. 201410372192.9, dated May 16, 2017, with partial English translation (11 pages).

*Primary Examiner* — Davis Hwu

(74) *Attorney, Agent, or Firm* — Hamre, Schumann, Mueller & Larson, P.C.

(57) ABSTRACT

A return waterbox for a heat exchanger, such as a shell-and-tube heat exchanger, is provided. The return waterbox may include an insert configured to direct a fluid flow(s) in the return waterbox. In some embodiments, such as in a two-pass heat exchanger, the insert can be configured to receive water from one portion of the heat exchanger tubes in the first pass and redirect the received water to another portion of the heat exchanger tubes in the second pass.

18 Claims, 5 Drawing Sheets

(56) References Cited

U.S. PATENT DOCUMENTS

| | | | |
|---|---|---|---|
| 7,261,148 | B2 | 8/2007 | Rohrbaugh et al. |
| 2013/0092355 | A1 | 4/2013 | Douglas et al. |

* cited by examiner

RETURN WATERBOX FOR HEAT EXCHANGER

FIELD

The disclosure herein relates to a return waterbox for a heat exchanger, such as a shell-and-tube heat exchanger of a chiller system. More particularly, the disclosure herein relates to methods, systems and apparatuses configured to regulate a fluid flow(s) in the return waterbox.

BACKGROUND

Shell-and-tube heat exchangers are often used, for example in a chiller system, as a condenser and/or an evaporator of the chiller system. Typically, the shell-and-tube heat exchangers are configured to include heat exchanger tubes extending inside a sealed shell. The heat exchanger tubes define a tube side configured to carry a first fluid (e.g. water); and the shell defines a shell side configured to carry a second fluid (e.g. refrigerant). The tube side and the shell side can form a heat exchange relationship to transfer heat between the first fluid and the second fluid.

Some shell-and-tube heat exchangers may have a multi-pass design (e.g. two-pass design). One end of the shell-and-tube heat exchanger may be configured to have a return waterbox that is generally configured to receive the first fluid from the tube side in the first pass and return the first fluid to the tube side in the second pass.

SUMMARY

A return waterbox for a heat exchanger, such as a shell-and-tube heat exchanger, is provided. The return waterbox may generally be configured to invert flow directions in a multi-pass shell-and-tube heat exchanger, particularly a shell-and-tube heat exchanger with a side-by-side water head configuration. Generally, the term "invert" means, relative to a vertical direction, that the fluid flow in the upper (or lower) section of a tube side in the first pass is redirected to the lower (or upper) section of the tube side in the second pass respectively. The return waterbox may include a structure that is configured to divide the return waterbox into at least two compartments and direct a fluid flow(s) (e.g. water flows) in the compartments. In some embodiments, the structure may include, for example, an insert positioned inside the return waterbox configured to invert the fluid flow(s). In some embodiments, the return waterbox may include one or more partitions to divide the return waterbox into a plurality of compartments and components, such as flow passages, external to the return waterbox to direct a fluid flow(s) between the compartments. The return waterbox can be configured to help reduce water by-pass in the heat exchangers.

Embodiments disclosed herein are generally directed to a return waterbox of a heat exchanger that is configured to direct a water flow. However, it is to be appreciated that the embodiments disclosed herein can be adapted to work with other fluids.

In some embodiments, the return waterbox may be configured to have a return waterbox cover and an insert. The return waterbox cover may be configured to have an open end and a closed back, which define a cavity together. The insert may be positioned in the cavity of the return waterbox cover. The insert and the open end of the return waterbox cover can form a front compartment including a first water flow path; and the insert and the back end of the return waterbox cover can form a back compartment including a second water flow path.

In some embodiments, a direction of the first water flow path and a direction of the second water flow path may be different. In some embodiments, the direction of the first water flow path and the direction of the second water flow path may have a relatively diagonal relationship.

In some embodiments, in the front compartment including the first water flow path, the insert may have a first portion and a second portion in fluid communication. In some embodiments, the first portion may be configured to receive water from at least some of the heat exchanger tubes, and the insert may be configured to direct the received water to the second portion. The second portion may be configured to direct the received water into at least some of the heat exchanger tubes.

In some embodiments, the insert may be configured to have a main divider and a wall that generally encircles the main divider. In some embodiments, a portion of the main divider and the wall may be shaped to follow a contour of an inner surface of the cavity of the return waterbox cover. In some embodiments, the first portion and the second portion may be relatively diagonally positioned relative to a vertical direction of the return waterbox.

In some embodiments, the first portion of the insert may be configured to receive water from at least some of the heat exchanger tubes positioned relatively close to an upper section of the heat exchanger tube bundle, and the second portion of the insert may be configured to direct water into at least some of the heat exchanger tubes positioned relatively close to a lower section of the heat exchanger tube bundle. In some embodiments, the heat exchanger tubes positioned relatively close to an upper section of the heat exchanger tube bundle can be made of a material that has a relatively lower heat transfer capability and/or is relatively cheaper than copper, such as steel. Therefore, the return waterbox may also help reduce the cost of the heat exchanger.

In some embodiments, the insert and the back end of the return waterbox may form the back compartment. In some embodiments, the insert and the open end may define a first open area and a second open area, the first open area and the second open area may be in fluid communication through the back compartment of the return waterbox cover. In some embodiments, the first open area may be configured to receive water from at least some of the heat exchanger tubes, the back end may be configured to direct the water from the first open area to the second open area, and the second open area may be configured to direct water out of the return waterbox cover into some of the heat exchanger tubes.

In some embodiments, the first open area and the second open area may be relatively diagonally positioned relative to a vertical direction of the return waterbox cover.

In some embodiments, the return waterbox may include a structure external to the return waterbox that may be configured to invert a fluid flow in the waterbox. In some embodiments, the return waterbox may be divided into a plurality of compartments, such as four compartments by a partition. The return waterbox may include external flow passages in fluid communication with the plurality of compartment to invert the water flow directions among the plurality of compartments.

Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A is a side schematic view of the shell-and-tube heat exchanger. FIG. 1B is a perspective view of a water header with a side-by-side configuration.

FIG. 2A is a front perspective view of the return waterbox. FIG. 2B is an exploded view of the return waterbox.

FIG. 5A illustrates a front view of the return waterbox. FIG. 5B illustrates a rear view of the return waterbox.

DETAILED DESCRIPTION

Figure 1A:
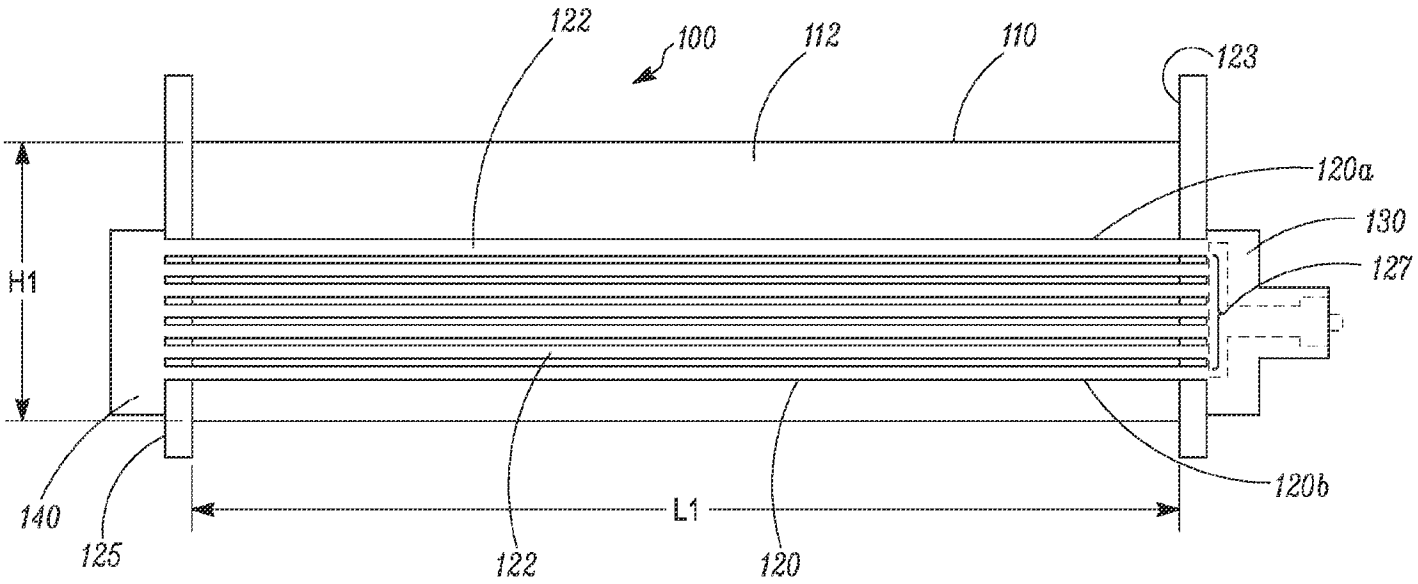
FIGS. 1A and 1B illustrate a schematic view of a shell-and-tube heat exchanger.

Some heating, ventilation and air conditioning systems, such as may include a commercial chiller(s), often have one or more shell-and-tube heat exchangers to function as a condenser and/or an evaporator. Typically, a tube side of the heat exchanger is configured to carry a first fluid, such as water; and the shell side is configured to carry a second fluid, such as refrigerant. When the heat exchanger functions as a condenser, the shell side is typically configured to carry hot refrigerant vapor and the tube side is configured to carry a process fluid, such as water. The hot refrigerant vapor can transfer heat to the water while the refrigerant vapor is condensed into liquid refrigerant. When the heat exchanger functions as an evaporator, the shell side is typically configured to carry cold liquid refrigerant or a refrigerant vapor/liquid mixture and the tube side is configured to carry a process fluid, such as water. Heat can be transferred from the water to the refrigerant in the evaporator, so that a temperature of the water is lowered while the refrigerant is vaporized.

In a shell-and-tube heat exchanger, heat exchanger tubes are typically positioned inside the shell side and configured to extend longitudinally through the shell side. The heat exchanger tubes can be configured to have at least one process fluid pass. In some heat exchangers, the process fluid can be directed into at least some of the heat exchanger tubes from a first longitudinal end of the shell. In a single pass heat exchanger, the process fluid is generally directed out of the heat exchanger tubes from a second longitudinal end of the shell. Some shell-and-tube heat exchanger may have a multi-pass design. In the multi-pass heat exchanger, the process fluid can be configured to flow into a return waterbox at the second longitudinal end of the shell from, for example, the first pass, and be directed into at least some of the heat exchanger tubes to flow back to the first longitudinal end of the shell in, for example, the second pass. Heat exchange between the process fluid and the refrigerant can occur when the process fluid flows through the heat exchanger tubes in one or more passes.

In some heat exchangers, such as in a flooded evaporator, the heat exchanger tubes are stacked as a bundle from a lower section of the evaporator. The heat exchanger tubes close to an upper section of the bundle may not have efficient heat exchange with refrigerant because the refrigerant may not be able to effectively wet the heat exchanger tubes close to the upper section of the bundle, causing water by-pass in the evaporator, while the heat exchanger tubes close to the lower section of the bundle can cool the water in the heat exchanger tubes more effectively. The term "water by-pass" generally means that water flowing through the tube side has limited or no contact with heat exchanger tubes that are wetted by the refrigerant. When this occurs, the elevated return water temperature of the water leaving the heat exchanger tubes close to the upper section of the bundle may mix with the water that has a relatively lower water temperature leaving the heat exchanger tubes close to the lower section of the bundle, producing a mixed water temperature that is between the two temperatures. To compensate for the elevated temperature leaving the heat exchanger tubes close to the upper section of the bundle, the compressor may have to increase its lift (e.g. discharge pressure minus the evaporator pressure), which may cause the chiller to be less efficient under certain operation conditions, such as, for example at partial load conditions. Improvements can be made to, for example, reduce water by-pass, in the heat exchangers.

Embodiments described herein provide a return waterbox of a shell-and-tube heat exchanger that is configured to direct a fluid flow(s) in the return waterbox. The return waterbox may be configured to be in fluid communication with the tube side of the heat exchanger. In some embodiments, the return waterbox can have a structure that is configured to receive water from one portion of the heat exchanger tubes and redirect the received water to another portion of the heat exchanger tubes. In some embodiments, the return waterbox can be configured to receive water from a portion of the heat exchanger tubes positioned relatively close to an upper section of the heat exchanger tube bundle and redirect the received water to a portion of the heat exchanger tubes that are positioned relatively close to a lower portion of the heat exchanger tube bundle. In some embodiments, the return waterbox may be configured to include an insert that is configured to receive and redirect at least a portion of the water received by the return waterbox. In some embodiments, the insert may be configured to divide the return waterbox into a front compartment and a back compartment relative to a longitudinal direction of the heat exchanger in use. The front compartment of the return waterbox may be configured to receive and redirect a water flow differently from the back compartment of the return waterbox. The return waterbox may help direct the water to flow in different portions of the heat exchanger tubes to receive a similar amount of heat exchange with the refrigerant in the shell side.

References are made to the accompanying drawings that form a part hereof, and in which is shown by way of illustration of the embodiments in which the embodiments may be practiced. It is to be understood that the terms used herein are for the purpose of describing the figures and embodiments and should not be regarding as limiting the scope of the present application. The embodiments as disclosed herein are generally directed to a heat exchanger that is configured to direct a water flow. It is to be noted that the heat exchanger can also be adapted to direct other fluids.

Figure 1B:
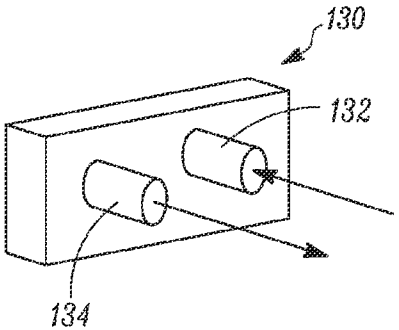

FIGS. 1A and 1B illustrate a schematic view of a shell-and-tube heat exchanger 100 of two water passes, which can be used as a condenser and/or an evaporator in, for example, a commercial chiller. The heat exchanger 100 includes a shell 110 that generally defines a shell side 112; and heat exchanger tubes 120 that generally define a tube side 122. The heat exchanger tubes 120 are stacked inside the shell 110 to form a heat exchanger tube bundle 127 that has an upper section 120*a* and a lower section 120*b* relative to a vertical direction defined by a height H1.

The shell side 112 can be configured to carry a first fluid, such as refrigerant, and the tube side 122 can be configured to carry a second fluid, such as water. The first fluid in the shell side 112 can form a heat exchange relationship with the second fluid in the tube side 122.

The shell 110 of the heat exchanger 100 has a length L1 that defines a longitudinal direction. The shell 110 has a first end 123 and a second end 125 along the longitudinal direction. A water header 130 is attached to the first end 123 and is in fluid communication with the heat exchanger tubes 120 and the tube side 122. A return waterbox 140 is attached to the second end 125 and is in fluid communication with the heat exchanger tubes 120 and the tube side 122.

As illustrated in FIG. 1B, the water header 130 includes a water inlet 132 and a water outlet 134. The water inlet 132 can be configured to receive a fluid, for example, water; and the water outlet 134 can be configured to direct the water out of the heat exchanger 100. The water header 130 can distribute the water received from the water inlet 132 into the tube side 122, and/or receive the water from the tube side 122 and direct the water out of the heat exchanger 100 from the water outlet 134.

In the illustrated embodiment of FIG. 1B, the water inlet 132 and the water outlet 134 are in a side-by-side configuration. This is exemplary. In other embodiments, the water inlet 132 and the water outlet 134 may be arranged in, for example, an up-and-down configuration, or other suitable configurations.

Referring to FIG. 1A, in operation, the water can be directed into the tube side 122 in the water header 130 from the water inlet 132. The water can flow through the heat exchanger tubes 120 in the longitudinal direction from the first end 123 toward the second end 125. The water can flow out of the tube side 122 into the return waterbox 140 at the second end 125. In the return waterbox 140, the water can be directed into the tube side 122 to flow toward the first end 123. The water can then be directed out of the water header 130 at the first end 123 from the outlet 134.

The shell side 112 can be configured to carry, for example, refrigerant. If the heat exchanger 100 is configured to work as a condenser, the shell side 112 is generally configured to carry hot refrigerant vapor. The hot refrigerant vapor can release heat to the water in the tube side 122, and be condensed to liquid refrigerant. If the heat exchanger 100 is configured to work as an evaporator, the shell side 112 can be configured to carry, for example, cold liquid refrigerant or a refrigerant liquid/vapor mixture. The water in the tube side 122 can release heat to the liquid refrigerant and/or the refrigerant liquid/vapor mixture so as to lower a temperature of the water.

Heat exchange efficiency between the first fluid (e.g. refrigerant) in the shell side 112 and the second fluid (e.g. water) in the tube side 122 may be affected by various factors, such as how well the heat exchanger tubes 120 may be wetted by the refrigerant in the shell side 112. For example, when the heat exchanger 100 is a flooded evaporator, the shell side 112 generally includes liquid refrigerant that is configured to wet the heat exchanger tubes 120. The heat exchanger tubes 120 that are positioned relatively close to the upper section 120*a* of the heat exchanger tube bundle 127 may be prone to ineffective wetting when, for example, the liquid refrigerant charge in the shell side 112 is relatively low and/or during certain partial load conditions. Consequently, the water in the heat exchanger tubes 120 close to the upper section 120*a* of the heat exchanger tube bundle 127 may have less heat exchange efficiency with the refrigerant in the shell side 112 compared to the heat exchanger tubes 120 closer to the lower section 120*b* of the heat exchanger tube bundle 127. When the water header 130 is in a side by side configuration as illustrated in FIG. 1B, the water distributed to the heat exchanger tubes 120 close to the upper section 120*a* of the heat exchanger tube bundle 127 may also likely return to the heat exchanger tubes 120 close to the upper section 120*a* in the return waterbox 140. This portion of water, therefore, may not exchange heat effectively with the refrigerant in the two passes. When this portion of water returns to the water header 130, a temperature of this portion of water may be relatively higher than other portions of water returning from other heat exchanger tubes 120, such as the heat exchanger tubes 120 that are closer to the lower section 120*b* of the heat exchanger tube bundle 127. When this situation occurs, the portion of water that returns to the water header 130 from the heat exchanger tubes 120 and that are close to the upper section 120*a* may have an elevated temperature compared to the water returns to the water header 130 from the heat exchanger tubes 120 that are close to the lower section 120*b*. When the water mixes in the water header 130, the temperature of the water may be higher than the desired temperature. To compensate for the elevated temperature of the water returns to the water header 130 from the heat exchanger tubes that are close to the upper section 120*a*, the compressor lift (e.g. discharge pressure minus the evaporator pressure) may have to be increased, which may cause the chiller to be less efficient under certain operation conditions, such as for example, partial load. This may affect the overall heat exchange efficiency of heat exchanger 100.

Figure 2A:
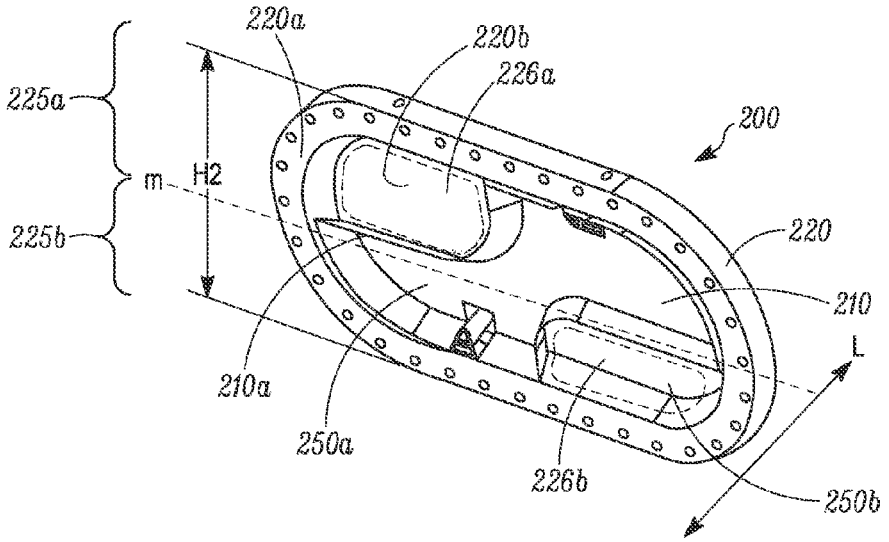
FIGS. 2A and 2B illustrate an embodiment of a return waterbox that includes an insert.
Figure 2B:
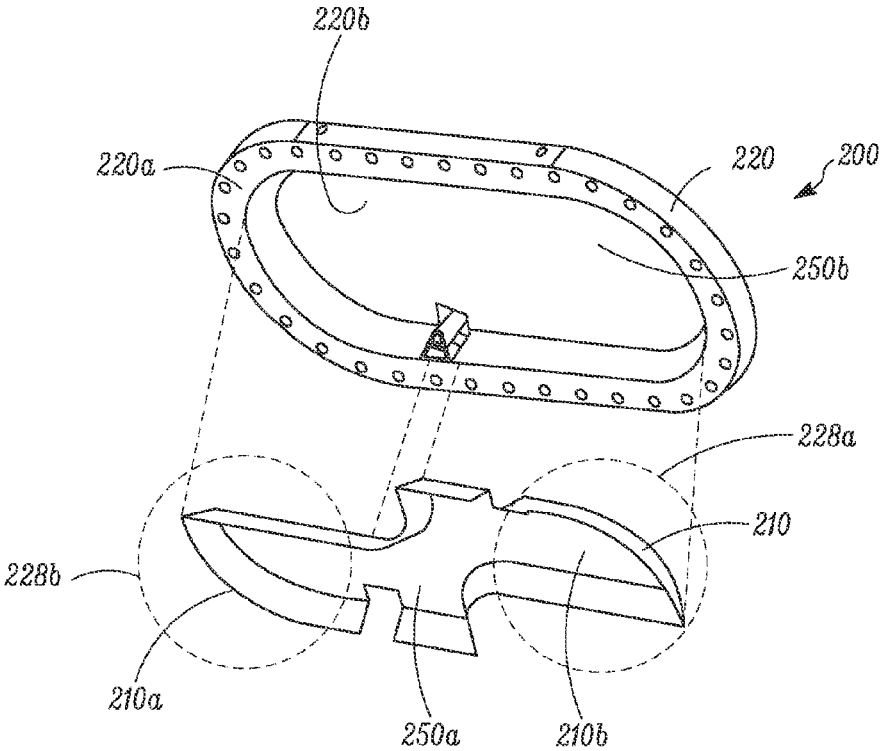

FIGS. 2A and 2B illustrate a return waterbox 200 that can be used with the heat exchanger 100 as illustrated in FIG. 1A. The return waterbox 200 is configured to include a structure, such as an insert 210, that can be configured to receive and redirect water in the return waterbox 200.

The return waterbox 200 includes a waterbox cover 220 that has an open end 220*a* and a closed back end 220*b* relative to a longitudinal direction L that is similar to the longitudinal direction defined by L1 in FIG. 1A. Generally, the return waterbox 200 forms a cavity from the open end 220*a* to the back end 220*b*. The cavity can be configured to receive and redirect, for example, water from heat exchanger tubes (e.g. the heat exchanger tubes 120 as illustrated in FIG. 1A).

Referring to FIG. 2B, the insert 210 includes an outer wall 210*a* following an outer perimeter of a main divider 210*b* of the insert 210. The outer wall 210*a* and the main divider 210*b* define the insert 210, which can be used to receive and redirect water in the insert 210.

The insert 210 can be received by the cavity of the return waterbox cover 220 from the open end 220*a*. At least a portion of the outer wall 210*a* and the main divider 210*b* is configured to conform to a contour or perimeter of the cavity of the return waterbox cover 220. When the insert 210 is positioned in the return waterbox cover 220, the insert 210 generally defines a front compartment 250*a*, and a space between the main divider 210*b* of the insert 210 and the back end 220*b* of the return waterbox cover 220 generally defines a back compartment 250*b*. The front compartment 250*a* and the back compartment 250*b* are adjacent in the longitudinal direction L. The front compartment 250*a* and the back compartment 250*b* can be configured to receive and redirect a water flow in the return waterbox 200, forming a first water flow path and a second water flow path respectively.

In a vertical direction that is defined by H2 of the return waterbox 200, the return waterbox 200 can be divided into an upper section 225*a* and a lower section 225*b* by a line m that is located at about a middle position along the height H2. Referring to FIG. 1A, when the return waterbox 200 is used with the heat exchanger 100, the upper section 225*a* may generally be positioned relatively close to the upper section 120*a* of the heat exchanger tube bundle 127; and the lower section 225*b* can generally be positioned relatively close to the lower section 120*b* of the heat exchanger tube bundle 127. The line m is generally positioned at a middle portion of the heat exchanger tube bundle 127, dividing the upper section 120*a* and the lower section 120*b*.

The insert 210 is shaped so that when the insert 210 is positioned in the cavity of the return waterbox 200, a first portion 228*a* of the insert 210 is generally positioned in the upper section 225*a* of the return waterbox 200, and a second portion 228*b* of the insert 210 is generally positioned in the lower section 225*b* of the return waterbox 200. The first portion 228*a* and the second portion 228*b* are generally relatively diagonally positioned relative to the vertical direction that is defined by the height H2 and are in fluid communication. The first portion 228*a* and the second portion 228*b* are in fluid communication and are generally configured to direct a first water flow in the front compartment 250*a*. The insert 210 can also divert water to flow to the back compartment 250*b* of the return waterbox 200.

The insert 210 is also shaped so that when the insert 210 is positioned in the return waterbox 200, the outer wall 210*a* and the open end 220*a* define a first open area 226*a* in the upper section 225*a* and a second open area 226*b* in the lower section 225*b* of the return waterbox 200. The first open area 226*a* and the second open area 226*b* are in fluid communication and are configured to allow water to flow into and pass through the back compartment 250*b* of the return waterbox 200 in a space between the back end 220*b* and the insert 210. The first open area 226*a* and the second open area 226*b* are generally diagonally positioned relative to the vertical direction that is defined by the height H2.

Figure 3:
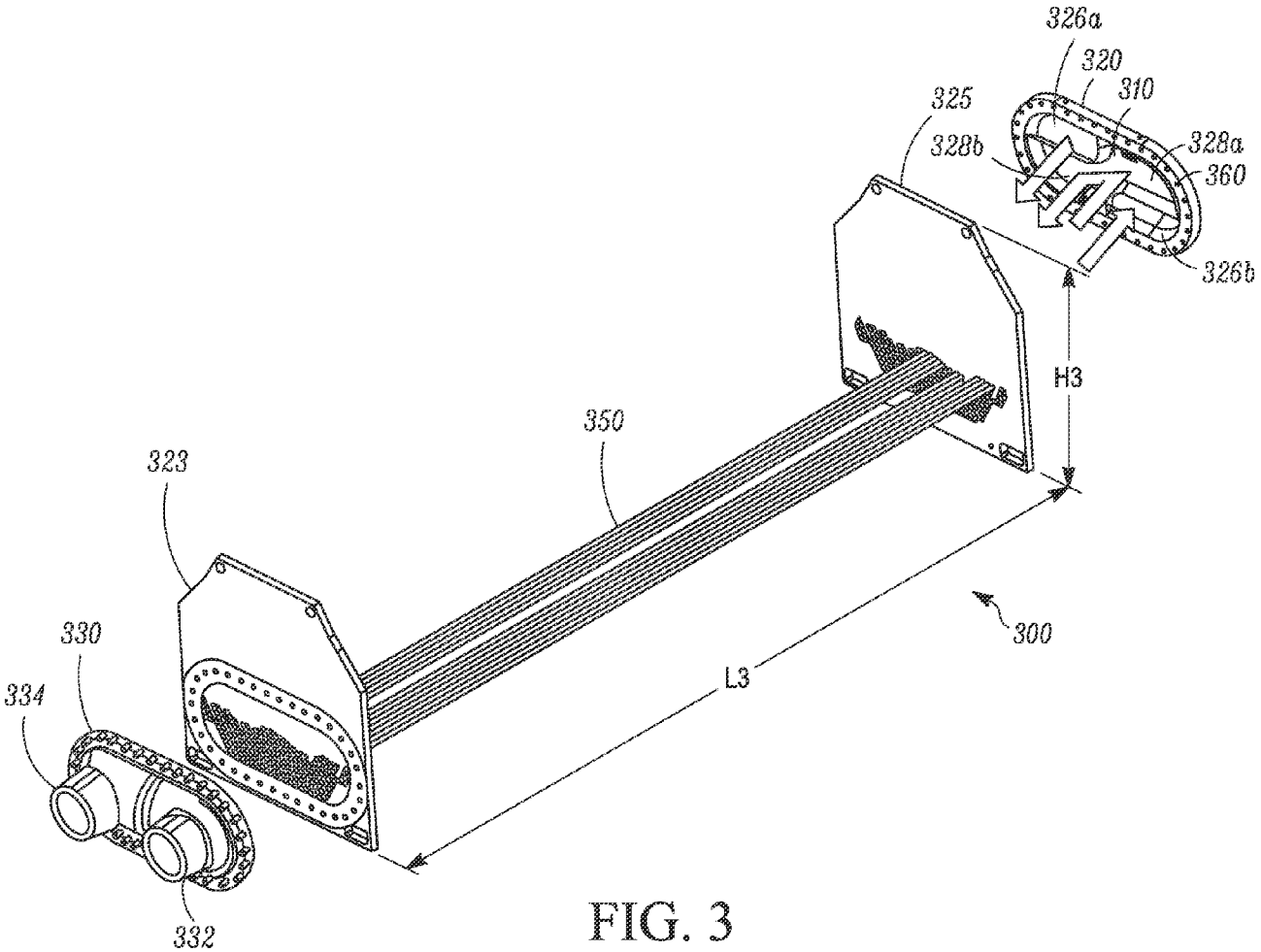
FIG. 3 illustrates a schematic view of a shell-and-tube heat exchanger that is equipped with a return waterbox with an insert. A shell and some of the heat exchanger tubes are removed for a clearer illustration.

The return waterbox, such as the return waterbox 200 can be used with, for example, the heat exchanger 100 as illustrated in FIG. 1A. FIG. 3 illustrates a perspective view of a heat exchanger 300, with its shell and some heat exchanger tubes removed for a clearer view.

The heat exchanger 300 includes a water header 330, which has a water inlet 332 and a water outlet 334. The water inlet 332 and the water outlet 334 are in a side by side configuration as illustrated, with the appreciation that other configurations may also be used.

The heat exchanger 300 also includes a return waterbox 320, which is configured similarly to the return waterbox 220 as illustrated in FIG. 2. The return waterbox 320 is configured to include an insert 310, which is configured to include a first portion 328*a* and a second portion 328*b* in fluid communication. The insert 310 is also shaped to form a first open area 326*a* and a second open area 326*b* with a cover 360 of the return waterbox 320.

The heat exchanger 300 has a longitudinal direction that is defined by a length L3. In the longitudinal direction, the heat exchanger 300 has a first end 323 and a second end 325. The water header 330 is attached to the first end 323 of the heat exchanger 300; and the return waterbox 320 is attached to the second end 325 of the heat exchanger. Heat exchanger tubes 350 extend between the first end 323 and the second end 325 in the longitudinal direction. The heat exchanger 300 is configured to have a two-pass configuration.

A U-shaped arrow and straight arrows illustrate one example of water flow directions in the return waterbox 320 when the heat exchanger 300 is in operation. The water can be directed into the water header 330 from the water inlet 332, and directed into at least some of the heat exchanger tubes 350. The water passes through the heat exchanger tubes 350 along the longitudinal direction and flows into the return waterbox 320. This forms the first water pass. In the orientation as shown, the water in the first water pass is generally received by the first portion 328*a* of the insert 310 (see the U-shaped arrow) and the second open area 326*b* (see the straight arrows).

The water received by the first portion 328*a* of the insert and the second open area 326*b* can form two water flows respectively with different directions in the return waterbox 300. As illustrated by the U-shaped arrow in FIG. 3, the water received by the first portion 328*a* is generally directed diagonally relative to a vertical direction that is defined by a height H3 of the heat exchanger 300 toward the second portion 328*b*, forming the first water flow path. The water received by the second open area 326*b* is generally directed diagonally relative to the vertical direction toward the first open area 326*a*, forming the second water flow path (see the straight arrows). The water exits the return waterbox 320 from the first open area 326*a* and the second portion 328*b*. The water can then enter the heat exchanger tubes 350 again to flow back to the water header 330 and out of the outlet 334, forming the second pass. A direction of the first water flow path and a direction of the second water flow path in the return waterbox 320 have a relatively diagonal relationship.

Relative to the vertical direction that is defined by the height H3, the first portion 328*a* and the first open area 326*a* are generally positioned in an upper section (see, for illustration purposes, the upper section 225*a* of the return waterbox 200 in FIG. 2A); and the second portion 328*b* and the second open area 326*b* are generally positioned in the lower section (see, for illustration purposes, the lower section 225*b* of the return waterbox 200 in FIG. 2A). By using the insert 310, the water from the first pass received by the first portion 328*a* in the upper portion can be directed toward the second portion 328*b* in the lower portion to enter the heat exchanger tubes 350 in the second pass. The water from the first pass received by the second open area 326*b* in the lower portion is directed toward the first open area 326*a* in the upper portion 325*a* to enter the heat exchanger tubes 350 in the second pass.

Referring to FIGS. 1 and 3 together, the water flow pattern described herein may help invert the water flow direction from the first pass to the second pass. The water flow in the heat exchanger tubes 350 positioned relatively close to an upper section of the heat exchanger tube bundle (see, for example, the upper section 120*a* of the heat exchanger tube bundle 127 in FIG. 1) in the first pass is directed toward the heat exchanger tubes 350 positioned relatively close to a lower section (see, for example, the lower section 120*b* of the heat exchanger tube bundle 127) in the second pass. The water flow in the heat exchanger tubes 350 positioned relatively close to the lower section in the first pass is redirected toward the heat exchanger tubes 350 positioned relatively close to the upper section in the second pass. At the end of the two passes, the water in the tube side (such as the tube side 122*a* in FIG. 1A) generally passes through the heat exchanger tubes 350 both the upper section and the lower section of the heat exchange bundle (e.g. inversion of the waterflow in the two passes). This inversion of water flows relative to the vertical direction can help the water in the heat exchanger tubes 350 to receive relatively uniform heat exchange in the two passes. This can also help the water to have a relatively uniform temperature after the two passes.

It is to be appreciated that in some embodiments, the arrangement of the water inlet 332 and the water outlet 334 of the water header 330 can be switched. The water can be directed into the water header 330 from the water outlet 334 and out of the water header 330 from the water inlet 332.

It is to be appreciated that the water flow pattern in the return waterbox can be varied by configuring the insert (such as the insert 210 in FIG. 2A) differently. A desired water flow pattern (e.g. inversion) can be achieved by configuring the insert. The embodiments as illustrated in FIGS. 2A, 2B and 3 can help the water flow in the heat exchanger tubes to invert relative to the vertical direction from the first pass to the second pass. The term "invert" can be relative to the vertical direction. This is exemplary. The return waterbox and insert can also be configured to achieve other water flow patterns in the return waterbox. In general, the insert can be configured to direct the water flow from a first selected portion of the heat exchanger tubes in the first pass to a second selected portion of the heat exchanger tubes in the second pass. To achieve this, a portion of the insert may be positioned corresponding to the first selected portion of the heat exchanger tubes in the return waterbox, which can be configured to receive the water from the first selected portion of the heat exchanger tubes in the first pass. Another portion of the insert may be positioned corresponding to the second selected portion of the heat exchanger tubes in the return waterbox, which can be configured to direct the water into the second selected portion of the heat exchanger tubes. The first portion and the second portion of the insert can be configured to be in fluid communication, therefore a desired waterflow pattern from the first selected portion of the heat exchanger tubes and the second selected portion of the heat exchanger tubes can be achieved.

The insert may also be shaped so that a first open area (which is defined by the insert and a cover of the return waterbox) of the return waterbox may be configured to receive the water from a portion of the heat exchanger tubes in the first pass. A second open area of the return waterbox may be configured to direct the water into another portion of the heat exchanger tubes. The return waterbox may also be configured to include more than one insert, each of which may be configured to direct water in different flow patterns in the return waterbox.

The heat exchanger tubes are typically made of a relatively efficient heat conducting material, such as copper, in a traditional design. A diameter of the heat exchanger tubes may also be optimized for heat exchanging efficiency. However, the top section of the heat exchanger tube bundle may not exchange heat efficiently in the heat exchanger because of, for example, water by-pass in a traditional design. The embodiments as disclosed herein can help reduce water by-pass. Consequently, the heat exchanger tubes in areas that may be prone to water by-pass can be made of heat exchanger tubes that may not be optimized for heat exchange efficiency, for example, to reduce the cost of making the heat exchanger. In some embodiments, some of the heat exchanger tubes, such as the heat exchanger tubes 120 relatively close to the upper section 120*a* of the heat exchanger tube bundle 127 as illustrated in FIG. 1A may be made of a material that has a relatively lower heat transfer capability and/or is relative cheaper than copper, such as steel. In some embodiments, because such heat exchanger tubes are disposed in areas that may be prone to water by-pass, the diameter of such heat exchange tubes may not be critical to achieve a certain heat exchange efficiency. For example, ready made stock steel pipes (or other non-technical tube type pipes) may be used in such areas. In some embodiments, the heat exchanger tubes 120 relatively close to the upper section 120*a* of the heat exchanger tube bundle 127 may have a larger diameter compared to heat exchanger tubes close to the lower section 120*b* of the heat exchanger tube bundle 127 (or typical heat exchanger tubes) to reduce the cost of the heat exchanger tubes 120 and the labor cost to install, because less number of heat exchanger tubes 120 are needed when heat exchanger tubes with a relatively larger diameter are used. The tube sheet can also be sized to accommodate various heat exchanger tube configurations. The heat exchanger tubes 120 with a larger diameter and/or the tube sheet may also help reinforce the tube sheet to control deflection. In these embodiments, the insert and the return waterbox can be configured so that the water flowing in the heat exchanger tubes of the relatively less efficient heat conducting material in one pass can be directed into heat exchanger tubes of the relatively high heat conducting material in the other pass(es). The water flowing in the heat exchanger tubes of the relatively high efficient heat conducting material in one pass can be directed into heat exchanger tubes of the relatively low heat conducting material in the other pass(es). Because the flow though the heat exchanger tubes with lower efficiency may be routed into the heat exchanger tubes with higher efficiency or vice versa, the performance of the heat exchanger may be improved or at least similar relative to those conditions where the heat exchanger tubes in the upper section are not completely wetted by the refrigerant. Using steel tubes and/or heat exchanger tubes with a relatively large diameter can help reduce the cost of the heat exchanger, while still maintaining the overall heat exchange efficiency of the heat exchanger and/or a temperature uniformity in the water.

In some embodiments, the insert (e.g. the insert 310) may be configured to retrofit existing shell-and-tube heat exchangers, such as an evaporator or a condenser. The insert may be installed in such heat exchangers, for example, during a maintenance procedure.

Figure 4:
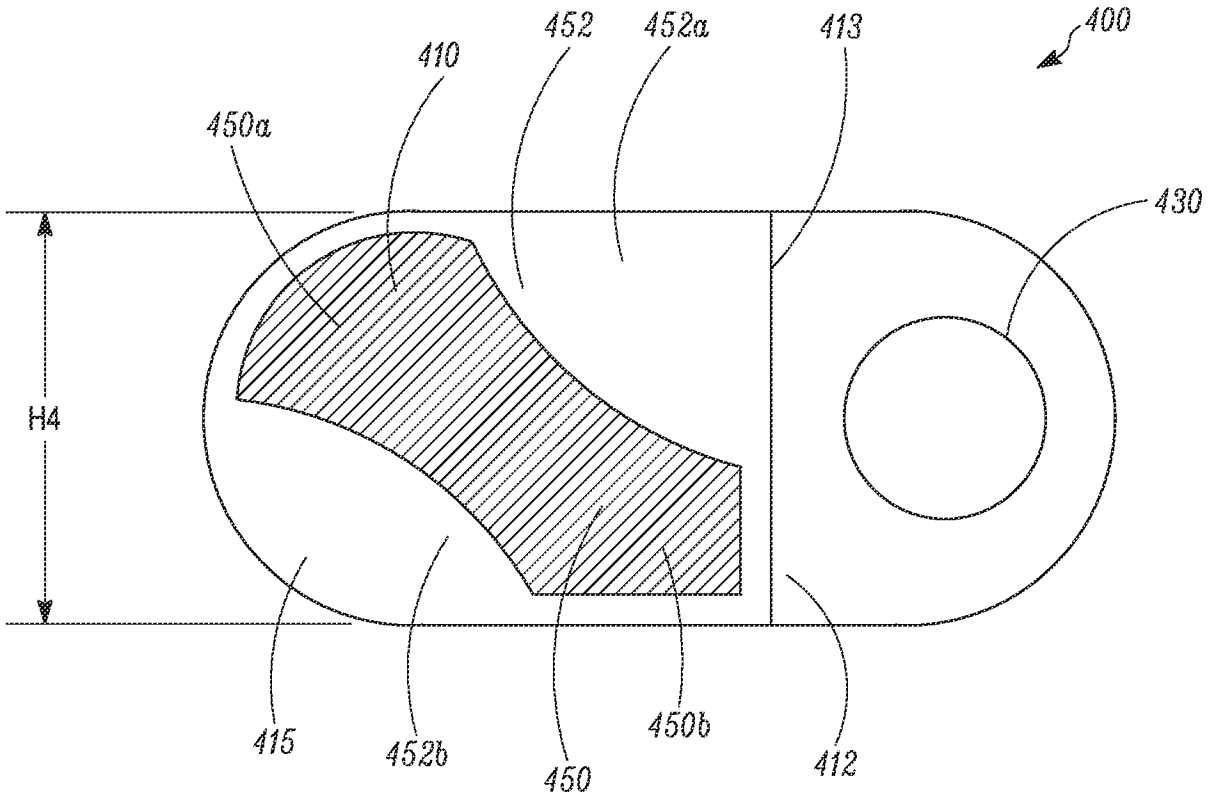
FIG. 4 illustrates an end view of another embodiment of a return waterbox that includes an insert.

In some embodiments, the insert may be configured to be used in a shell-and-tube heat exchanger that has more than two passes. FIG. 4 illustrates an embodiment of a return waterbox 400 that can be used in a three-pass heat exchanger (not shown). The return waterbox 400 is divided into two chambers, a first chamber 412 and a second chamber 415, by a partition 413. The first chamber 412 has a water port 430, which can be configured to receive water, or direct water out of the heat exchanger. The second chamber 415 is equipped with an insert 410, which can divide the second chamber 415 into a front chamber 450 and a back chamber 452. The configuration of the second chamber 415 is similarly to the return waterbox 200 as illustrated in FIG. 2A. The front chamber 450 has a first portion 450*a* and a second portion 450*b*. The back chamber 452 has a first open area 452*a* and a second open area 452*b*.

In operation, the water can be directed into the heat exchanger from the water port 430, and directed into heat exchanger tubes (not shown) to form a first pass. The second chamber 415 can receive the water in the second pass. The insert 410 and the second chamber 415 can form two waterflow paths to help, for example, invert the water flows relative to a vertical direction that is defined by a height H4 when the water flows out of the second chamber 415. As illustrated, the first portion 450*a* and the second portion

450*b* of the front chamber 450 can form a first water flow path, and a first open area 452*a* and 452*b* of the back chamber 452 can form a second water flow path that generally has a different direction as the first water flow path.

It is to be appreciated that the insert 410 is for illustration purpose only. The insert 410 can be configured differently in other embodiments.

It is to be appreciated that a heat exchanger (e.g. heat exchanger 100 in FIG. 1) may have two return waterboxes that are configured similarly to the return waterbox 400, one of which may be positioned at a first end of the heat exchanger (e.g. the first end 123 of the heat exchanger 100) and the other one of which may be positioned on the second end of the heat exchanger (e.g. the second end 125 of the heat exchanger 100).

Figure 5A:
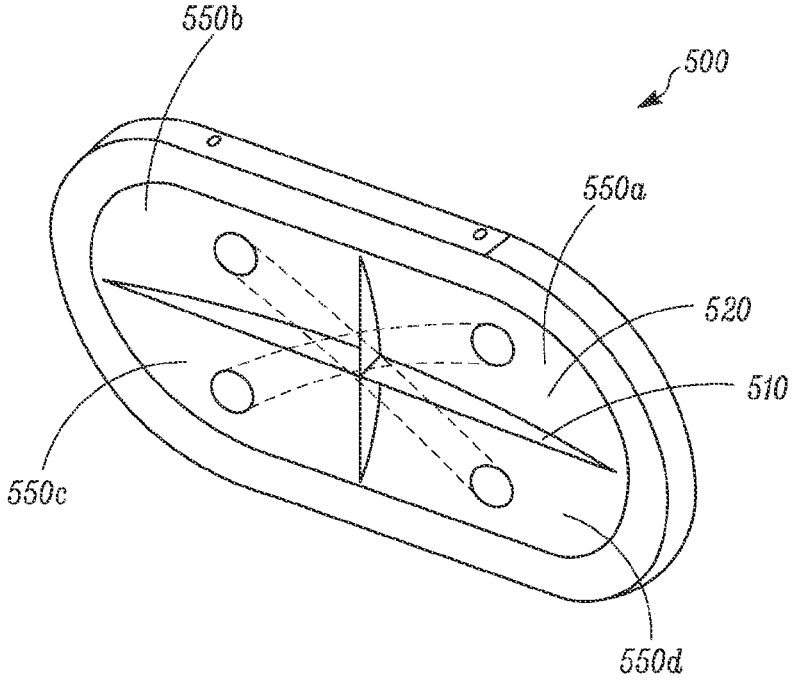
FIGS. 5A and 5B illustrate yet another embodiment of a return waterbox that include external flow passages.
Figure 5B:
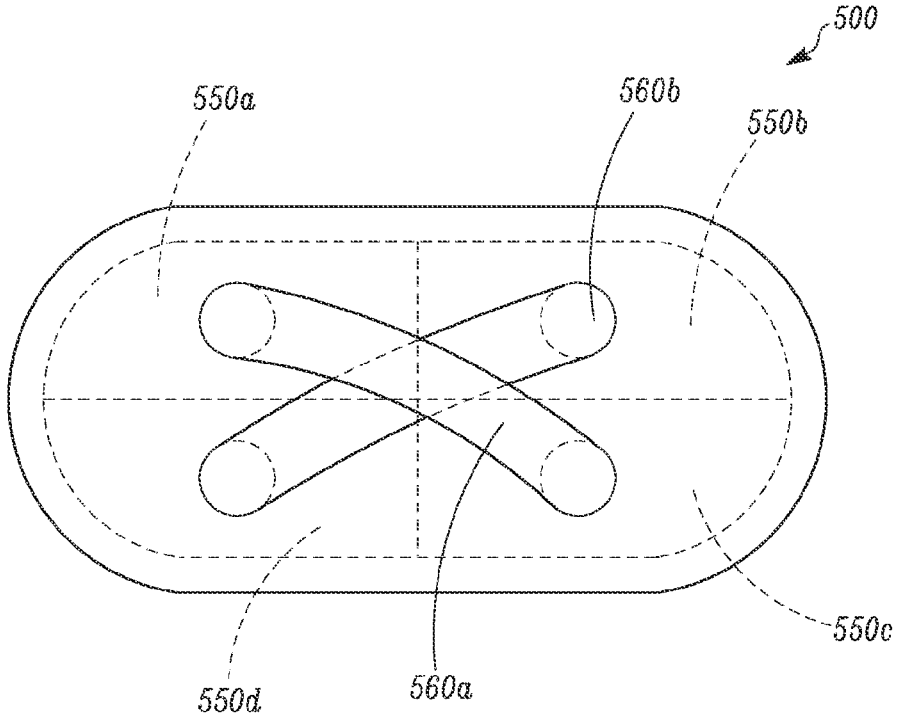

FIGS. 5A and 5B illustrate another embodiment of a return waterbox 500. As shown in FIG. 5A, the return waterbox 500 includes a cavity 520. The cavity 520 can be divided into a plurality of compartments 550*a*, 550*b*, 550*c* and 550*d* by a partition 510. In the illustrated embodiment, the partition 510 is configured to divide the cavity 520 into four compartments 550*a* to 550*d*, with the notion that the partition 510 can be configured to divide the cavity 520 into other number of compartments. Generally, the compartments 550*a* and 550*b* are arranged at a relatively upper section of the cavity 520, while the compartments 550*c* and 550*d* are arranged at a relatively lower section of the cavity 520.

Referring to FIGS. 5A and 5B, each of the compartments 520*a* to 550*d* is in fluid communication with an external flow passage 560*a* or 560*b*. The term "external" generally means that the flow passages 560*a* and 560*b* are not positioned inside the cavity 520 of the return waterbox 500. The external flow passages 560*a* and 560*b* are generally configured to direct a fluid flow from one compartment to another compartment.

In the illustrated embodiment, the compartments 550*a* and 550*c* are in fluid communication with the first flow passage 560*a*. The compartments 550*b* and 550*d* are in fluid communication with the second flow passage 560*b*. The first flow passage 560*a* and the second flow passage 560*b* are generally in a diagonal relationship. The flow passages 560*a* and 560*b* can generally invert the flow direction in the return waterbox 500 in the illustrated embodiment.

It is to be appreciated that the return waterbox 500 can be divided into other number of compartments, and the flow passages can be arranged to direct the flow directions in other patterns.

It is to be appreciated that the return waterbox as described herein can be used with various types of shell and tube heat exchangers, such as falling film evaporators, flooded evaporators, and condensers.

Aspects

Any of aspects 1-7 can be combined with any of aspects 8-22. Any of aspects 8-9 can be combined with any of aspects 10-22. Any of aspects 10-19 can be combined with any of aspects 20-22. Aspect 21 can be combined with aspect 22.

Aspect 1. A return waterbox for a heat exchanger, comprising:

a return waterbox cover having an open end and a back end; and an insert positioned in the return waterbox cover;

wherein the insert defines a first water flow path, and a space between the insert and the back end of the return waterbox cover defines a second water flow path.

Aspect 2. The return waterbox of aspect 1, wherein a direction of the first water flow path and the direction of the second water flow path are different relative to a vertical direction of the return waterbox.

Aspect 3. The return waterbox of aspects 1-2, wherein a direction of the first water flow path and a direction of the second water flow path has a diagonal relationship.

Aspect 4. The return waterbox of aspects 1-3, wherein the insert has a first portion and a second portion in fluid communication, the first portion is configured to receive water, and the insert is configured to direct the received water to the second portion.

Aspect 5. The return waterbox of aspect 4, wherein at least a portion of the first portion and at least a portion of the second portion are shaped to conform to a profile of the open end, and the first portion and the second portion are diagonally positioned relative to a vertical direction of the return waterbox.

Aspect 6. The return waterbox of aspects 1-5, wherein the insert and the open end are configured to form a first open area and a second open area, the first open area and the second open area are in fluid communication through a space between the insert and the back end of the return waterbox, the first open area is configured to receive water and the second end is configured to direct water out of the return waterbox.

Aspect 7. The return waterbox of aspect 6, wherein the first open area and the second open area are diagonally positioned relative to a vertical direction of the return waterbox.

Aspect 8. A return waterbox for a heat exchanger, comprising:

a return waterbox;

a partition dividing the return waterbox into a first compartment and a second compartment; and a first flow passage that is external to the return waterbox cover forming fluid communication between the first compartment and the second compartment.

Aspect 9. The return waterbox for a heat exchanger of aspect 8, further comprising:

a third compartment and a fourth compartment divided by the partition; and a second flow passage;

wherein that second flow passage is external to the return waterbox cover and form fluid communication between the third compartment and the fourth compartment.

Aspect 10. A shell-and-tube heat exchanger, comprising:

a shell, heat exchanger tubes extending longitudinally in the shell; and a return waterbox cover on a first longitudinal end of the heat exchanger, the return waterbox cover having an open end and a back end; and an insert positioned in the return waterbox cover;

wherein the insert defines a first water flow path, and a space between the insert and the back end of the return waterbox cover defines a second water flow path.

Aspect 11. The shell-and-tube heat exchanger of aspects 10, wherein a direction of the first water flow path and a direction of the second water flow path are different.

Aspect 12. The shell-and-tube heat exchanger of aspects 10-11, wherein a direction of the first water flow path and a direction of the second water flow path has a diagonal relationship.

Aspect 13. The shell-and-tube heat exchanger of aspects 10-12, wherein the insert has a first portion and a second portion in fluid communication, the first portion is configured to receive water from a first portion of the heat exchanger tubes, the insert is configured to direct the received water to the second portion, and the second portion is configured to direct the received water into a second portion of the heat exchanger tubes.

Aspect 14. The shell-and-tube heat exchanger of aspect 13, wherein at least a portion of the first portion and at least a portion of the second portion are shaped to conform to a profile of the open end, and the first portion and the second portion are diagonally positioned relative to a vertical direction of the return waterbox.

Aspect 15. The shell-and-tube heat exchanger of aspects 10-14, wherein the insert and the open end are configured to form a first open area and a second open area, the first open area and the second open area are in fluid communication through the back end of the return waterbox cover, the first open area is configured to receive water from a first portion of the heat exchanger tubes, the back end is configured to direct the water from the first open area to the second open area, and the second open area is configured to direct water out of the return waterbox cover into a second portion of the heat exchanger tubes.

Aspect 16. The shell-and-tube heat exchanger of aspect 15, wherein the first open area and the second open area are diagonally positioned relative to a vertical direction of the return waterbox cover.

Aspect 17. The shell-and-tube heat exchanger of aspects 10-16, wherein the first portion of the insert is configured to receive water from at least some of the heat exchanger tubes positioned relatively close to an upper section of the heat exchanger tubes, and the second portion of the insert is configured to direct water into at least some of the heat exchanger tubes positioned relatively close to a lower section of the heat exchanger tubes.

Aspect 18. The shell-and-tube heat exchanger of aspects 10-17, wherein the heat exchanger tubes positioned relatively close to an upper section of the heat exchanger tubes are made of a material that has a relatively lower heat transfer capability than copper.

Aspect 19. The shell- and tube heat exchanger of aspects 10-18, wherein the heat exchanger tubes positioned relatively close to an upper section of the heat exchanger tubes are configured to have a diameter that is larger than the heat exchanger tubes positioned relatively close to a lower section of the heat exchanger tubes.

Aspect 20. A method of managing a fluid flow in a tube side of a heat exchanger, comprising:

at a first end of the heat exchanger, directing a portion of a fluid into heat exchanger tubes located in an upper section of the heat exchanger;

at a second end of the heat exchanger, receiving the portion of the fluid from the heat exchanger tubes located in the upper section of the heat exchanger;

at the second end of the heat exchanger, directing the portion of the fluid received from the heat exchanger tubes located in the upper section of the heat exchanger toward heat exchanger tubes located in a lower section of the heat exchanger; and at the first end of the heat exchanger, receiving the portion the fluid from the heat exchanger tubes located in the lower section of the heat exchanger.

Aspect 21. A method of managing a fluid flow in a tube side of a heat exchanger; comprising:

at a first end of the heat exchanger, directing a portion of a fluid into heat exchanger tubes located in a lower section of the heat exchanger;

at a second end of the heat exchanger, receiving the portion of the fluid from the heat exchanger tubes located in the lower section of the heat exchanger;

at the second end of the heat exchanger, directing the portion of the fluid received from the heat exchanger tubes located in the lower section of the heat exchanger toward heat exchanger tubes located in an upper section of the heat exchanger; and at the first end of the heat exchanger, receiving the portion the fluid from the heat exchanger tubes located in the upper section of the heat exchanger.

Aspect 22. A heating, ventilation and air conditioning system, comprising:

a heat exchanger including a first end and a second end;

the first end including a waterhead configured to direct a fluid into a tube side of the heat exchanger;

the second end including a return waterbox configured to receive the fluid from the tube side of the heat exchanger and redirect the fluid into the tube side of the heat exchanger;

the return waterbox including an open end and a back end; and an insert positioned in the waterbox; wherein the insert defines a first water flow path, and a space between the insert and the back end of the return waterbox cover defines a second water flow path.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. A return waterbox for a heat exchanger, comprising:

a return waterbox cover having an open end and a back end; and an insert positioned inside the return waterbox cover and configured to receive and redirect water within the insert, the insert including a main divider and an outer wall that extends outward from a major surface of the main divider and is at least partially disposed on an outer perimeter of the main divider, wherein the insert defines a first water flow path within the insert, and a space between the main divider and the back end of the return waterbox cover defines a second water flow path.

2. The return waterbox of claim 1, wherein a direction of the first water flow path and a direction of the second water flow path are different relative to a vertical direction of the return waterbox.

3. The return waterbox of claim 1, wherein a direction of the first water flow path and a direction of the second water flow path have a diagonal relationship.

4. The return waterbox of claim 1, wherein the insert has a first portion and a second portion in fluid communication, the first portion is configured to receive water, and the insert is configured to direct the received water to the second portion.

5. The return waterbox of claim 4, wherein at least a portion of the first portion and at least a portion of the second portion are shaped to conform to a profile of the open end, and the first portion and the second portion are diagonally positioned relative to a vertical direction of the return waterbox.

6. The return waterbox of claim 1, wherein the insert and the open end are configured to form a first open area and a second open area, the first open area and the second open area are in fluid communication through the space between the insert and the back end of the return waterbox, the first open area is configured to receive water and the second open area is configured to direct water out of the return waterbox.

7. The return waterbox of claim 6, wherein the first open area and the second open area are diagonally positioned relative to a vertical direction of the return waterbox.

8. A shell-and-tube heat exchanger, comprising:

a shell;

heat exchanger tubes extending longitudinally in the shell; and a return waterbox, the return waterbox including:

a return waterbox cover on a first longitudinal end of the heat exchanger, the return waterbox cover having an open end and a back end, and an insert positioned in the return waterbox cover and configured to receive and redirect water within the insert, the insert including a main divider and an outer wall that extends outward from a major surface of the main divider and is at least partially disposed on an outer perimeter of the main divider, wherein the insert defines a first water flow path within the insert, and a space between the insert and the back end of the return waterbox cover defines a second water flow path, and the insert and the open end are configured to form a first open area and a second open area, the first open area and the second open area are in fluid communication through the space between the insert and the back end of the return waterbox cover, the first open area is configured to receive water from a first portion of the heat exchanger tubes, the back end is configured to direct the water from the first open area to the second open area, and the second open area is configured to direct water out of the return waterbox cover into a second portion of the heat exchanger tubes.

9. The shell-and-tube heat exchanger of claim 8, wherein a direction of the first water flow path and a direction of the second water flow path are different relative to a vertical direction of the return waterbox.

10. The shell-and-tube heat exchanger of claim 9, wherein a direction of the first water flow path and a direction of the second water flow path have a diagonal relationship.

11. The shell-and-tube heat exchanger of claim 8, wherein the insert has a first portion and a second portion in fluid communication, the first portion is configured to receive water from a first portion of the heat exchanger tubes, the insert is configured to direct the received water to the second portion, and the second portion is configured to direct the received water into a second portion of the heat exchanger tubes.

12. The shell-and-tube heat exchanger of claim 11, wherein at least a portion of the first portion and at least a portion of the second portion are shaped to conform to a profile of the open end, and the first portion and the second portion are diagonally positioned relative to a vertical direction of the return waterbox.

13. The shell-and-tube heat exchanger of claim 8, wherein the first open area and the second open area are diagonally positioned relative to a vertical direction of the return waterbox cover.

14. A shell-and-tube heat exchanger, comprising:

a shell;

heat exchanger tubes extending longitudinally in the shell; and a return waterbox, the return waterbox including:

a return waterbox cover on a first longitudinal end of the heat exchanger, the return waterbox cover having an open end and a back end, and an insert positioned in the return waterbox cover, wherein the insert defines a first water flow path within the insert and includes a first portion and a second portion in fluid communication, and a space between the insert and the back end of the return waterbox cover defines a second water flow path, the first portion of the insert is configured to receive water from at least some of the heat exchanger tubes positioned relatively close to an upper section of the heat exchanger tubes, and the second portion of the insert is configured to direct water into at least some of the heat exchanger tubes positioned relatively close to a lower section of the heat exchanger tubes.

15. The shell-and-tube heat exchanger of claim 14, wherein the heat exchanger tubes positioned relatively close to the upper section of the heat exchanger tubes are made of a material with a relatively lower heat transfer capability than copper.

16. The shell-and tube heat exchanger of claim 14, wherein the heat exchanger tubes positioned relatively close to the upper section of the heat exchanger tubes are configured to have a diameter that is larger than the heat exchanger tubes positioned relatively close to the lower section of the heat exchanger tubes.

17. A method of managing a fluid flow in a tube side of a heat exchanger, comprising:

at a first end of the heat exchanger, directing a first portion of a fluid into heat exchanger tubes located in an upper section of the heat exchanger;

at a second end of the heat exchanger, receiving the first portion of the fluid from the heat exchanger tubes located in the upper section of the heat exchanger and directing the first portion of the fluid received from the heat exchanger tubes located in the upper section of the heat exchanger toward heat exchanger tubes located in a lower section of the heat exchanger;

at the first end of the heat exchanger, directing a second portion of the fluid into the heat exchanger tubes located in the lower section of the heat exchanger; and at the second end of the heat exchanger, receiving the second portion of the fluid from the heat exchanger tubes located in the lower section of the heat exchanger and directing the second portion of the fluid received from the heat exchanger tubes located in the lower section of the heat exchanger toward heat exchanger tubes located in the upper section of the heat exchanger.

18. The return waterbox of claim 8, wherein the first portion of the insert is configured to receive water from at least some of the heat exchanger tubes positioned relatively close to an upper section of the heat exchanger tubes, and the second portion of the insert is configured to direct water into at least some of the heat exchanger tubes positioned relatively close to a lower section of the heat exchanger tubes.

* * * * *